US010598103B2

(12) United States Patent
Kim

(10) Patent No.: US 10,598,103 B2
(45) Date of Patent: Mar. 24, 2020

(54) METHOD FOR REINFORCING ANTI-ENGINE STALL AND VEHICLE

(71) Applicants: Hyundai Motor Company, Seoul (KR); Kia Motors Corporation, Seoul (KR)

(72) Inventor: Sung-Joo Kim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 125 days.

(21) Appl. No.: 15/852,647

(22) Filed: Dec. 22, 2017

(65) Prior Publication Data

US 2019/0003407 A1 Jan. 3, 2019

(30) Foreign Application Priority Data

Jun. 29, 2017 (KR) ..... 10-2017-0082581

(51) Int. Cl.

| | |
|---|---|
| ***F02D 41/00*** | (2006.01) |
| ***F02D 13/02*** | (2006.01) |
| ***F02D 31/00*** | (2006.01) |
| ***F02D 41/22*** | (2006.01) |
| *F02D 41/14* | (2006.01) |

(52) U.S. Cl.

CPC ..... *F02D 41/0002* (2013.01); *F02D 13/02* (2013.01); *F02D 13/0219* (2013.01); *F02D 31/001* (2013.01); *F02D 41/0097* (2013.01); *F02D 41/222* (2013.01); *F02D 41/009* (2013.01); *F02D 2041/001* (2013.01); *F02D 2041/1433* (2013.01); *F02D 2041/227* (2013.01); *F02D 2200/101* (2013.01); *F02D 2250/14* (2013.01)

(58) Field of Classification Search

CPC ..... F02D 41/0002; F02D 41/222; F02D 41/0097; F02D 41/009; F02D 2041/227; F02D 2041/1433; F02D 2041/001; F02D 2250/14; F02D 2200/101

See application file for complete search history.

(56) References Cited

U.S. PATENT DOCUMENTS 6,094,974 A * 8/2000 Yamagishi ..... F01L 1/34 123/90.16
6,302,085 B1 * 10/2001 Sekine ..... F02D 41/009 123/406.18

(Continued)

FOREIGN PATENT DOCUMENTS

JP 2000-104619 A 4/2000
JP 2001-342888 A 12/2001

(Continued)

*Primary Examiner* — Phutthiwat Wongwian
*Assistant Examiner* — Sherman D Manley
(74) *Attorney, Agent, or Firm* — Morgan, Lewis & Bockius LLP

(57) ABSTRACT

A method for reinforcing anti-engine stall may include performing a cam timing control for measuring engine speed of an engine wherein when abnormality of a crank position detector is detected by a controller, engine speed of the engine is controlled to be higher than that at the time when the abnormality of crank position detector occurs while maintaining position for cam phase control operation of a variable timing system.

18 Claims, 5 Drawing Sheets

(56) References Cited

U.S. PATENT DOCUMENTS

| | | | | |
|---|---|---|---|---|
| 6,505,128 | B1 * | 1/2003 | Shimizu | F01L 1/34 123/406.18 |
| 2002/0194903 | A1 * | 12/2002 | Ilzuka | F02D 41/009 73/114.27 |
| 2005/0278109 | A1 * | 12/2005 | Ando | F02D 41/009 701/112 |
| 2013/0092114 | A1 * | 4/2013 | Pietsch | F01L 1/34 123/90.17 |
| 2013/0180506 | A1 * | 7/2013 | Schule | F02D 35/023 123/472 |
| 2013/0269415 | A1 * | 10/2013 | Fayyad | G01M 15/06 73/1.79 |
| 2017/0138281 | A1 * | 5/2017 | Utley | F02D 41/009 |
| 2018/0340484 | A1 * | 11/2018 | Stewart | F02D 41/222 |

FOREIGN PATENT DOCUMENTS

| | | | |
|---|---|---|---|
| JP | 2006-220079 | A | 8/2006 |
| JP | 2013-167223 | A | 8/2013 |

* cited by examiner

METHOD FOR REINFORCING ANTI-ENGINE STALL AND VEHICLE

CROSS-REFERENCE(S) TO RELATED APPLICATIONS

The present application claims priority to Korean Patent Application No. 10-2017-0082581, filed on Jun. 29, 2017, the entire contents of which is incorporated herein for all purposes by this reference.

BACKGROUND OF THE INVENTION

Field of the Invention

The present invention relates to engine stall, and more particularly, to a vehicle in which engine stall prevention (hereinafter referred to as "anti-engine stall") is reinforced by performing engine control rapidly from the time point when an abnormal phenomenon occurs in a crank position detector.

Description of Related Art

In general, unwanted engine stall of an internal combustion engine vehicle is a phenomenon that must be avoided most preferentially.

A typical example of a method of preventing engine stall includes cam timing control using a crank position sensor (hereinafter referred to as CKPS). The cam timing control is implemented by controlling synchronization of the CKPS and abnormality of the CKPS and controlling cam phase operation of a variable valve timing system using a dedicated controller or an electronic control unit (ECU) of an engine as a controller.

In the instant case, the variable valve timing system includes a continuously variable valve timing (CVVT) means for directly controlling a camshaft to adjust advance/retard phase timing of a cam, a continuous variable valve duration (CVVD) means for controlling valve duration without changing valve lift, and a continuous variable valve lift (CVVL) means for controlling valve duration by changing valve lift.

For example, a cam timing control of synchronization of the CKPS is performed by counting a predetermined angle unit of the CKPS and utilizes a timer and the control of the engine is performed by controlling the variable valve timing system that synchronizes ignition timing of the engine with operation of the CKPS on the basis of top dead center of a stroke of a piston. A cam timing control of abnormality of the CKPS is performed in a manner of generating or displaying a code showing that trouble has been diagnosed resulting from occurrence of an abnormal phenomenon in the CKPS (e.g., diagnostic trouble code (DTC)) and the control of the engine is performed by controlling ignition timing of the engine on the basis of estimation values of revolutions per minute (RPM) of the engine, which are estimated based on detection values in the CKPS.

As a result, the cam timing control can prevent the engine from being stalled by exactly operating the ignition timing of the engine, which has greatest influence on the engine, and allows the control of the engine to be performed without engine stall even after error of the CKPS is diagnosed.

However, the cam timing control is an approach that it is difficult to completely prevent the engine from being stalled due to limitation in the manner of diagnosing error of the CKPS.

For example, in order for a diagnostic trouble code to be generated, a trouble phenomenon occurred in the CKPS must be maintained for a certain time period. Furthermore, abnormality of the CKPS can be controlled even after the diagnostic trouble code is generated and then error of the CKPS is confirmed. Such a condition that the problem phenomenon in the CKPS must be maintained for a certain time period results from consideration of disconnection of the CKPS, which returns to normal state after a short time period (e.g., about 2 seconds).

For example, structure of connecting a timing chain for a crankshaft and a camshaft fixes speed of the camshaft with the aid of gear ratio between the crankshaft and the timing chain but has a high possibility of occurring variation of the gear ratio at the time when the cam advances/retards, whereby determination of estimation values of the engine RPM using detection values of the CKPS until diagnosis of error of the CKPS is confirmed according to generation of DTC at the time of abnormality of the CKPS may be inaccurate or impossible.

As a result, since inaccurate estimation values of the engine RPM is inevitably used at the time when momentary problem of the CKPS occurs during control of the cam timing, engine stall cannot be completely prevented until the cam returns to its default position. Therefore, there is a demand for control of cam timing that can prevent engine stall even in a moment that a problem occurs in the CKPS.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method for reinforcing anti-engine stall and a vehicle, in which continuous modeling of revolutions per minute (RPM) of an engine is performed based on detection values of a camshaft position sensor (CMPS) and control of the engine is performed using modeling values of RPM of the engine, which are estimated based on the modeling of the RPM of the engine at the time of occurrence of abnormality of a crank position sensor (CKPS), so that it is possible to prevent engine stall that may occur before error diagnosis of the CKPS is confirmed and therefore a diagnostic trouble code is generated and it is possible to prevent engine stall that may occur by applying inaccurate estimation values of RPM in an engine RPM modeling values, which are brought by variation of gear ratios of a crankshaft and a camshaft due to advance/retard movement of the cam, when abnormal phenomenon of the CKPS is detected.

Other various aspects of the present invention can be understood by the following description, and become apparent with reference to the exemplary embodiments of the present invention. Also, it is obvious to those skilled in the art to which the present invention pertains that the objects and advantages of the present invention can be realized by the means as claimed and combinations thereof.

In accordance with one aspect of the present invention for accomplishing the object as mentioned above, a method for reinforcing anti-engine stall may include steps of: (A) identifying abnormality of a crank position sensor (CKPS) for enhancing modeling engine speed of an engine by a camshaft position sensor (CMPS) wherein when a controller detects abnormality of the CKPS after the engine is activated and controlled, detecting whether the CKPS is abnormal is performed; (B) performing cam timing control wherein when abnormality of the CKPS is not detected, ignition timing of the engine is controlled by controlling cam phase control operation of a variable timing system; (C) performing cam timing control before confirmation of abnormality of the CKPS wherein when abnormality of the CKPS is detected, the number of rotations of the engine is controlled to be higher than that at the time when abnormality of the CKPS occurs while maintaining position for cam phase control operation of the variable timing system, so that engine stall is prevented; and (D) performing cam timing control of abnormality of the CKPS wherein after the abnormality of the CKPS is detected and subsequently a diagnostic trouble code is displayed, the number of rotations of the engine is controlled to be equal to that at the time when the abnormality of the CKPS occurred.

In an exemplary embodiment of the present invention, controlling the number of rotations of the engine to be higher is performed by applying engine RPM modeling values estimated in engine RPM modeling which is continuously generated using detection values of the CMPS, which are generated when the engine is activated, until the DTC is displayed when a predetermined time elapses after occurrence of abnormality of the CKPS.

In an exemplary embodiment of the present invention, when maintenance of the position for cam phase control operation of the variable timing system is performed, the variable timing system is switched to a default state after its position is maintained in the state at the time when abnormality of the CKPS is detected.

In an exemplary embodiment of the present invention, the step of identifying abnormality of the CKPS is divided into (a-1) performing activation and control of the engine, (a-2) synchronizing the camshaft and the crankshaft along with identifying the default position of the variable timing system, (a-3) generating detection values of the CMPS for the camshaft and establishing values of engine control to the engine RPM modeling values based on these detection values, and (a-4) generating detection values of the CKPS for the crankshaft and identifying occurrence of abnormality of the CKPS based on these detection values.

In an exemplary embodiment of the present invention, the step of performing control before confirmation of abnormality of the CKPS may include: (c-1) identifying display of diagnostic trouble code according to the detection of abnormality of the CKPS with respect to the crankshaft after the engine is activated and controlled, (c-2) determining values of engine control to engine RPM modeling values in the engine RPM modeling generated by the detection values of the CMPS with respect to the camshaft when the diagnostic trouble code is not displayed, (c-3) maintaining the current position of the variable valve timing system at the time of occurrence of abnormality of the CKPS such that cam timing control of operation of the variable valve timing system is maintained after the engine RPM modeling values are estimated, (c-4) controlling the number of rotations of the engine to be higher is performed based on the engine RPM modeling values after the engine RPM modeling values are estimated so that engine stall of the engine is prevented, (c-5) returning the variable valve timing system back to the default position, and (c-6) confirming error diagnosis of the CKPS resulting from identification of display of the diagnostic trouble code based on the fact that the abnormality of the CKPS is maintained during a predetermined time period from the time of detecting abnormality of the CKPS, and maintaining the cam phase control operation of the variable valve timing system in the position at the time of detection of abnormality of the CKPS.

In an exemplary embodiment of the present invention, in the step of performing cam timing control, ignition timing of the engine is controlled along with controlling the cam phase control operation of the variable timing system based on the detection values of the CKPS when abnormality of the CKPS is not detected.

In an exemplary embodiment of the present invention, the step of performing control of abnormality of the CKPS prevents engine stall by controlling the number of rotations of the engine according to the estimation values of the engine RPM based on the detection values of the CMPS after the error diagnosis of the CKPS is confirmed.

In another aspect of the present invention for accomplishing the object as mentioned above, a vehicle may include: a camshaft position sensor (CMPS) for detecting rotation speed of a camshaft; an engine including a crank position sensor (CKPS) for detecting rotation speed of a crankshaft for transmitting rotational force to the camshaft; a variable valve timing system coupled to the camshaft to control an cam timing of the engine and control phase of a cam; and a controller for controlling the engine and the variable valve timing system respectively when inaccurate estimation values of RPM is derived by an engine RPM modeling values.

In an exemplary embodiment of the present invention, the controller may include a map for modeling the number of rotations of the engine (the "engine RPM modeling"), by which the engine RPM modeling is performed based on detection values of the CMPS, wherein the engine RPM modeling estimates engine RPM modeling values from the time when abnormality of the CKPS occurs until the time when a diagnostic trouble code is displayed and wherein the engine RPM modeling values are applied in controlling the number of rotations of the engine to be higher than that at the time when abnormality of the CKPS occurs so that engine stall is prevented.

In an exemplary embodiment of the present invention, the controller switches, when applying the engine RPM modeling values, the variable valve timing system to a default state while maintaining its position in the state at the time when abnormality of the CKPS is detected; maintains, after the diagnostic trouble code is displayed, the variable valve timing system in the position at the time when abnormality of the CKPS is detected and then applies the engine RPM estimation values estimated based on the detection values of the CMPS in controlling the engine speed of the engine for preventing engine stall of the engine; and completes error diagnosis of the CKPS after the diagnostic trouble code is displayed.

The method for reinforcing anti-engine stall, which is applied to the vehicle of the present invention, continuously utilizes detection values of the CMPS and thus implements the following advantages and effects in controlling the cam timing when inaccurate estimation values of RPM is derived by an engine RPM modeling values.

First, estimation values of the engine RPM based on detection values of the CMPS and an engine RPM modeling values based on the CMPS modeling are associated with each other in controlling the cam timing so that engine control performance is greatly enhanced. Second, since abnormality of the CKPS is divided into occurrence of trouble in the CKPS and a time period before DTC is generated and a time period after DTC is generated, it is possible to effectively prevent engine stall that can be caused before abnormality of the CKPS is diagnosed resulting from generation of DTC. Third, since maintenance of the current position and control of the default for the variable valve timing system are applied together when trouble of the CKPS occurs, it is possible to prevent deterioration of stability of the engine RPM that can be brought by the variable valve timing system applied to the camshaft connected to the crankshaft via a timing chain. Fourth, since reliability of control of the engine timing is enhanced and thus engine stall due to abnormality of the CKPS is prevented, merchantability of the variable valve timing system and the vehicle is greatly enhanced.

The methods and apparatuses of the present invention have other features and advantages which will be apparent from or are set forth in more detail in the accompanying drawings, which are incorporated herein, and the following Detailed Description, which together serve to explain certain principles of the present invention.

It is to be understood that both the foregoing general description and the following detailed description of the present invention are exemplary and explanatory and are intended to provide further explanation of the invention as claimed.

Figure 1:
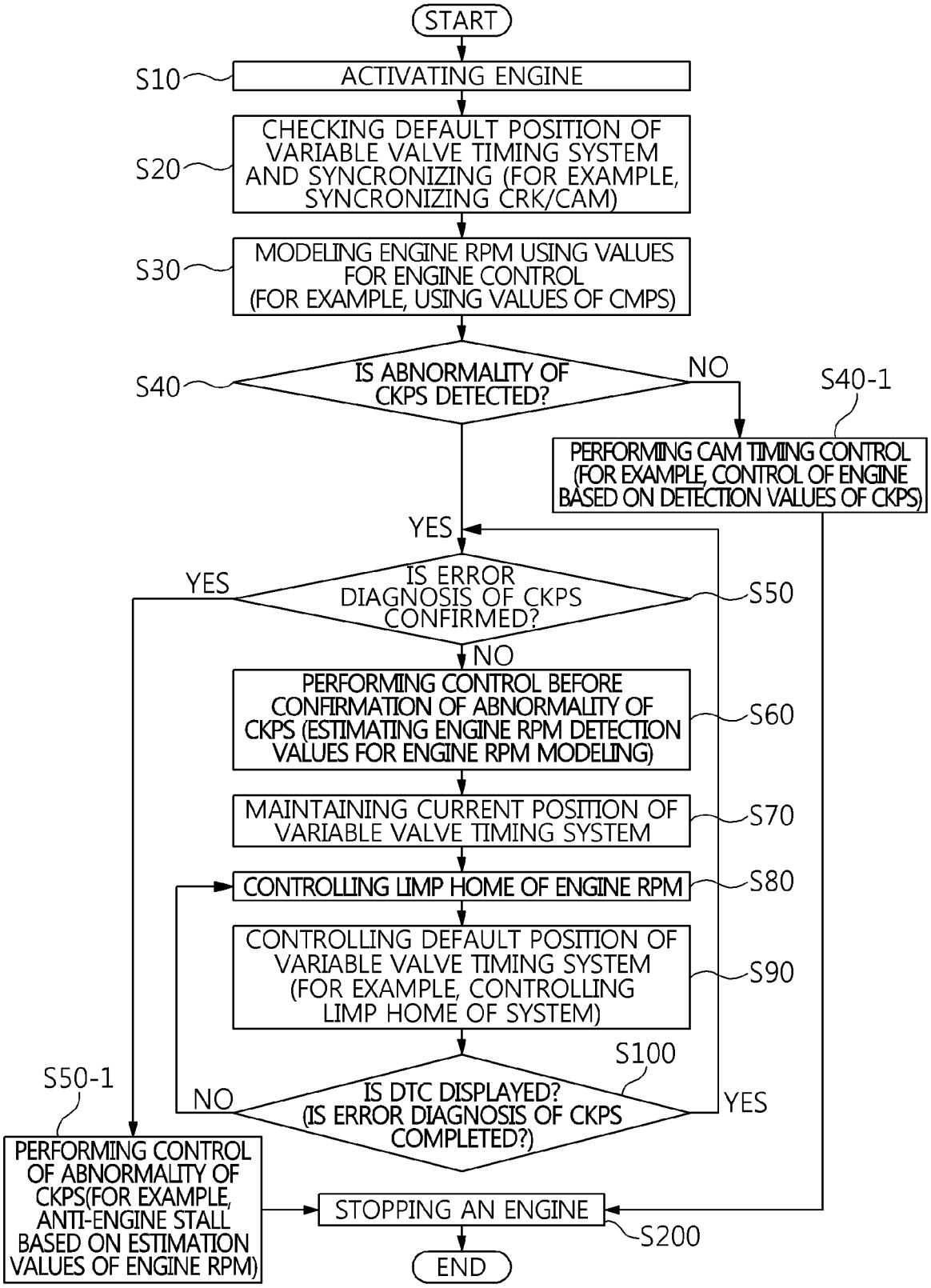
FIG. 1 is a flow chart of a method for reinforcing anti-engine stall according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIG. 1, the method is appropriated for reinforcing anti-engine stall when inaccurate estimation values of RPM is derived by an engine RPM modeling values. The method divided into steps of: identifying abnormality of the CKPS in steps S20 to S40 at the time of activation of an engine in step S10; performing cam timing control of synchronization of a cam when abnormality of the CKPS is not identified, in step S40-1; performing cam timing control before confirmation of abnormality of the CKPS in conjunction with a variable valve timing system that performs cam phase control from the time when abnormality of the CKPS occurs until the time when abnormality of the CKPS is diagnosed so that engine stall is prevented, in steps S50 to S100; and performing cam timing control of abnormality of the CKPS to prevent engine stall after diagnosis of abnormality of the CKPS is confirmed at the time when abnormality of the CKPS occurs, in step S50-1.

In the instant case, CMPS which is a camshaft position sensor measures rotation speed of a camshaft of which speed is fixed, using gear ratios of a crankshaft and a timing chain, of which respective gear ratios can vary at the time of advance/retard of a cam, while CKPS which is a crank position sensor measures engine speed, using rotation speed of the crankshaft. The rotation speed (or the number of rotations) means revolutions per minute (RPM).

Figure 2:
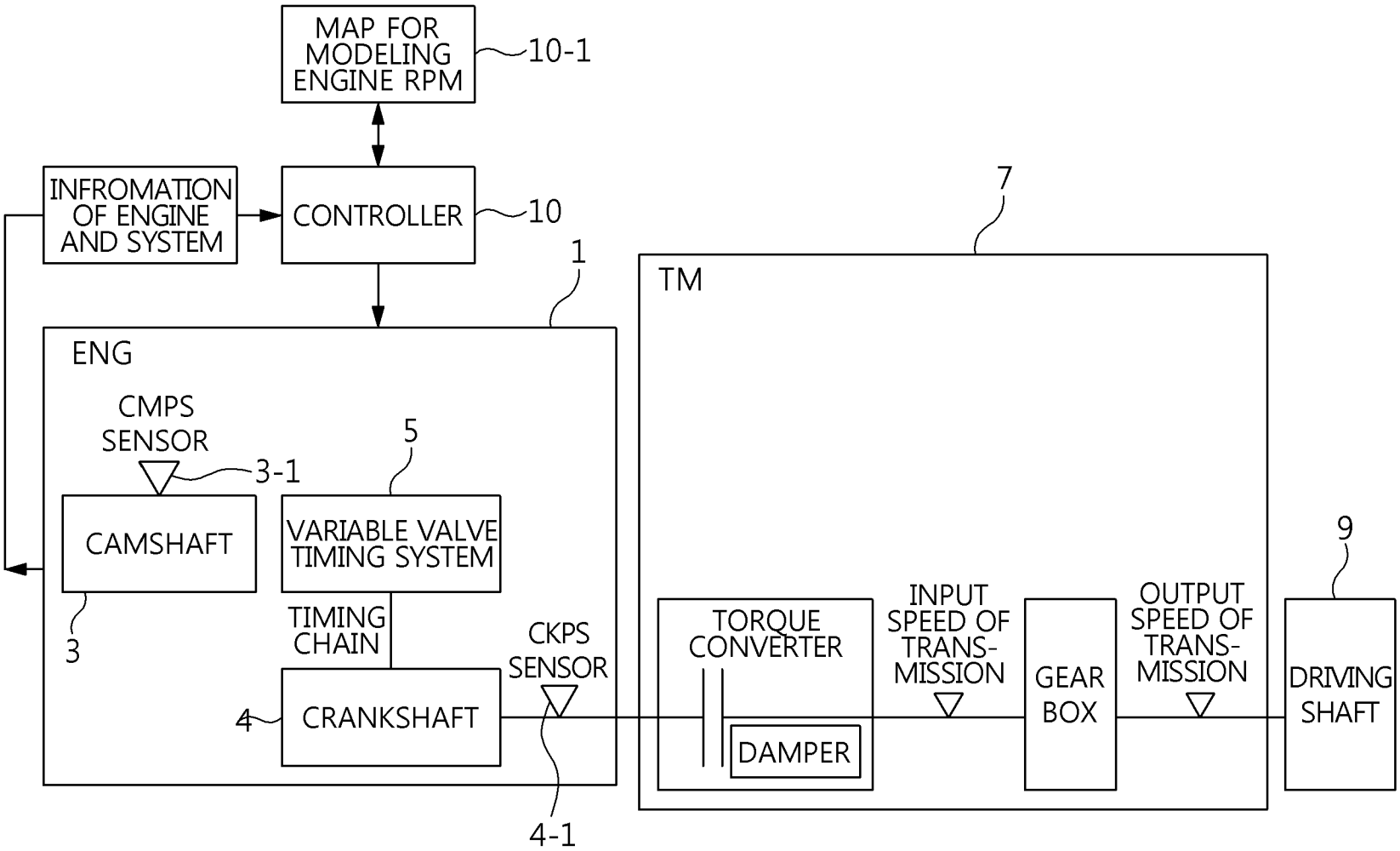
FIG. 2 is a schematic diagram of a vehicle in which reinforcement of anti-engine stall according to an exemplary embodiment of the present invention is implemented.

Referring to FIG. 2, the vehicle includes an engine 1 connected to a transmission 7 for transmitting power to a driveshaft 9 via a torque converter, a camshaft 3, a camshaft position sensor (CMPS) 3-1, a crankshaft 4, a crank position sensor (CKPS) 4-1, a variable valve timing system 5, and a controller 10.

For example, the engine 1 is an internal combustion engine. The camshaft 3 regulates opening and closing timing of intake and exhaust valve trains of the engine 1, the crankshaft 4 is rotated by reciprocating movement of pistons of the engine 1, and the camshaft 3 and the crankshaft 4 are connected to each other by a timing chain. The CMPS 3-1 measures or detects rotation speed (or RPM) of the camshaft 3. The CKPS 4-1 detects rotation speed (or RPM) of the crankshaft 4, on which determination of rotation speed (or RPM) of the engine 1 is based.

For example, the variable valve timing system 5 includes a Continuous Variable Valve Timing (CVVT) module coupled to the camshaft and fixed to the timing chain and controls ignition timing of the engine 1 by controlling cam phase with respect to advance/retard of the cam. The variable valve timing system 5 adopts hardware design condition that position thereof will be switched to a default state when control of cam phase operation stops due to its failure. Therefore, the variable valve timing system 5 includes a continuously variable valve timing (CVVT) devices for directly controlling the camshaft to adjust timing of the cam, a continuous variable valve duration (CVVD) device configured for controlling valve duration without changing valve lift, and a continuous variable valve lift (CVVL) devices for controlling valve duration by change of valve lift.

Hereinafter, description about the variable valve timing system 5 will be made with aiming at CVVT.

For example, the controller 10 treats information related to the engine resulting from activation of the engine 1 (e.g., cooling water temperature, oil temperature, pedal detection signal, etc.) and information related to operation of the variable valve timing system 5 and respective information related to the CMPS 3-1 and CKPS 4-1 as input data. Especially, the controller 10 is controlled for reinforcing anti-engine stall when inaccurate estimation values of RPM is derived by an engine RPM modeling values.

The controller 10 is associated with a map 10-1 for modeling the number of rotations of the engine. To this end, the controller 10 may be an electronic control unit (ECU) of the engine. Furthermore, the engine speed modeling map 10-1 allows for the engine RPM modeling which can be obtained in the control before confirmation of abnormality of the CKPS, the control before confirmation of abnormality of the CKPS being performed by receiving the measured values (or detection values) of rotation speed (or RPM) of the camshaft 3 detected by the CMPS 3-1 through the controller 10 or directly through the CMPS 3-1 and continuously utilizing the CMPS detection values of the CMPS 3-1 when the engine 1 is activated, preventing engine stall at the time point of occurrence of a failure diagnosis code (e.g., diagnostic trouble code (DTC)) at the time when trouble of the CKPS occurs.

Furthermore, the engine speed modeling map 10-1 may be configured to perform cam timing control of synchronization of the cam and cam timing control of abnormality of the CKPS in addition to the control before confirmation of abnormality of the CKPS. To this end, the engine speed modeling map 10-1 may be connected to a network independently from the controller 10, or may be integrated with the controller 10.

Hereinafter, the method for reinforcing anti-engine stall will be described more specifically on the basis of that applied to the cam timing control with reference to FIG. 3, FIG. 4, and FIG. 5. In the instant case, the subject of control is a controller 10 associated with the engine speed modeling map 10-1, while the object of control includes the engine 1 of which number of rotations is controlled and the variable valve timing system 5 that performs control of phase of the camshaft 3 and controls ignition timing of the engine 1. The control of the number of rotations of the engine is performed by controlling typical engine components for controlling fuel injection.

First, operation of the controller 10 is started simultaneously with activation and operation of the engine in step S10.

The operation of the controller 10 then enters the step of identifying abnormality of the CKPS wherein the step of identifying abnormality of the CKPS performed by checking the variable valve timing system and synchronization (for example, synchronization of CRK/CAM) in step S20, modeling RPM of the engine (for example, on the basis of values of the CMPS) in step S30, and detecting abnormality of the CKPS in step S40.

Figure 3:
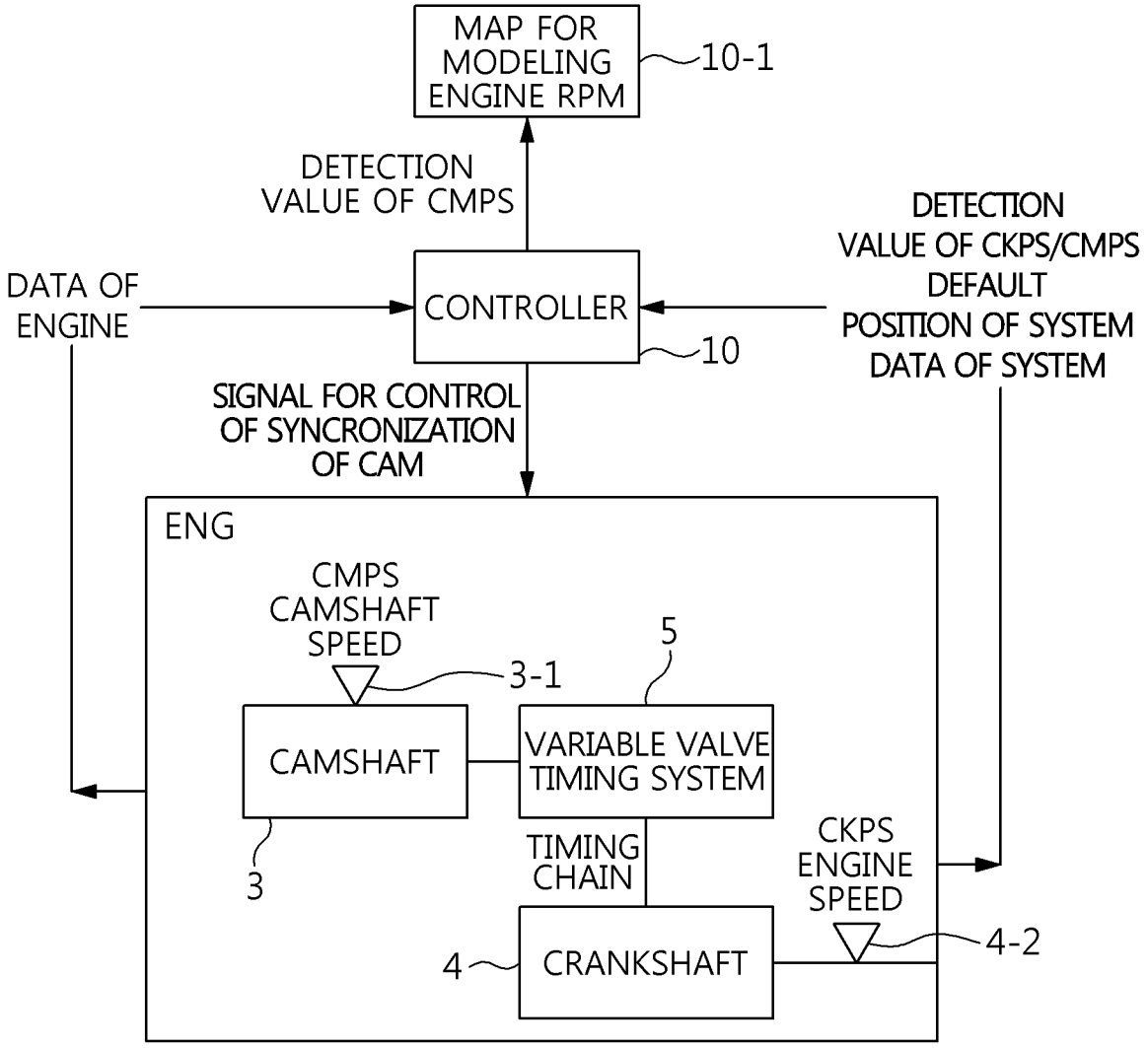
FIG. 3 is a block diagram showing a state of detecting trouble of a CKPS of a vehicle for reinforcing anti-engine stall according to an exemplary embodiment of the present invention.

Referring to FIG. 3, the controller 10 receives system data of the variable valve timing system 5 together with engine data of the engine 1 being operated, and performs the step S20. In the instant case, the engine data includes cooling water temperature, oil temperature, number of rotations of the engine, opening amount of a throttle and operation information related to an engine control mechanism, while the system data includes identification (or detection) of default position for the variable valve timing system 5, detection values of the CMPS 3-1 and detection values of the CKPS 4-1. Here, the default position depends on operation of the CKPS 4-1 on the basis of top dead center of a piston stroke applied to the control of timing of the CKPS. The detection values of the CMPS 3-1 are values of rotation speed (or RPM) of the camshaft 3 and the detection values of the CKPS 4-1 are values of rotation speed (or RPM) of the crankshaft 4, on which determination of rotation speed (or RPM) the engine 1 is based. The synchronization is meant by the state that the camshaft 3 and the crankshaft 4 are synchronized with each other by the timing chain.

The controller 10 is associated with the map 10-1 for modeling the number of rotations of the engine, and performs the step S30. The engine RPM modeling produces a plot diagram showing relationship between engine RPM and detection values of the CMPS wherein the diagram makes it possible to match a specific detection value of the CMPS with a specific engine RPM to estimate (or determine) a specific engine RPM modeling value. To this end, the plot diagram may be constructed as a plurality of plot diagram maps divided into certain areas. The plot diagram map may be constructed in the engine speed modeling map 10-1 and utilized in the controller 10, or constructed in the controller 10 using data of the engine speed modeling map 10-1.

As such, the controller 10 continuously monitors detection values of the CKPS 3-1, and performs step S30 in which occurrence of abnormal operation of the CKPS 3-1 is confirmed. In the instant case, a trouble phenomenon of the CKPS is meant by the state that a detection value of the CKPS, which is predetermined in conjunction with the engine RPM, is not normal wherein the trouble phenomenon includes disconnection of the CKPS, which occurs for a short time period of about 2 seconds and returns to the normal state, failure of the CKPS, which causes DTC after 2 seconds, and the like.

Afterwards, the controller 10 confirms abnormality of any detection value of the CKPS when inaccurate estimation values of RPM is derived by an engine RPM modeling values and then enters the step of confirming error diagnosis of the CKPS in step S50. The step of confirming error diagnosis of the CKPS in step S50 confirms abnormality of the CKPS according to whether or not a diagnostic trouble code is generated in the abnormal state in which any detection value of the CKPS would be abnormal. Therefore, when generation of the diagnostic trouble code is confirmed, the controller 10 proceeds to the step S50-1 in which abnormality of the CKPS is performed, whereas when generation of the diagnostic trouble code is not confirmed, the controller proceeds to steps S60 to S100 in which the control before confirmation of abnormality of the CKPS is performed.

The step of confirming abnormality of the CKPS is performed by applying the engine RPM modeling in step S60, controlling the variable valve timing system in step S70, controlling the engine in step S80, controlling position of the variable valve timing system in step S90 and diagnosing error of the CKPS in step S100, which are conducted by the controller 10.

Figure 4:
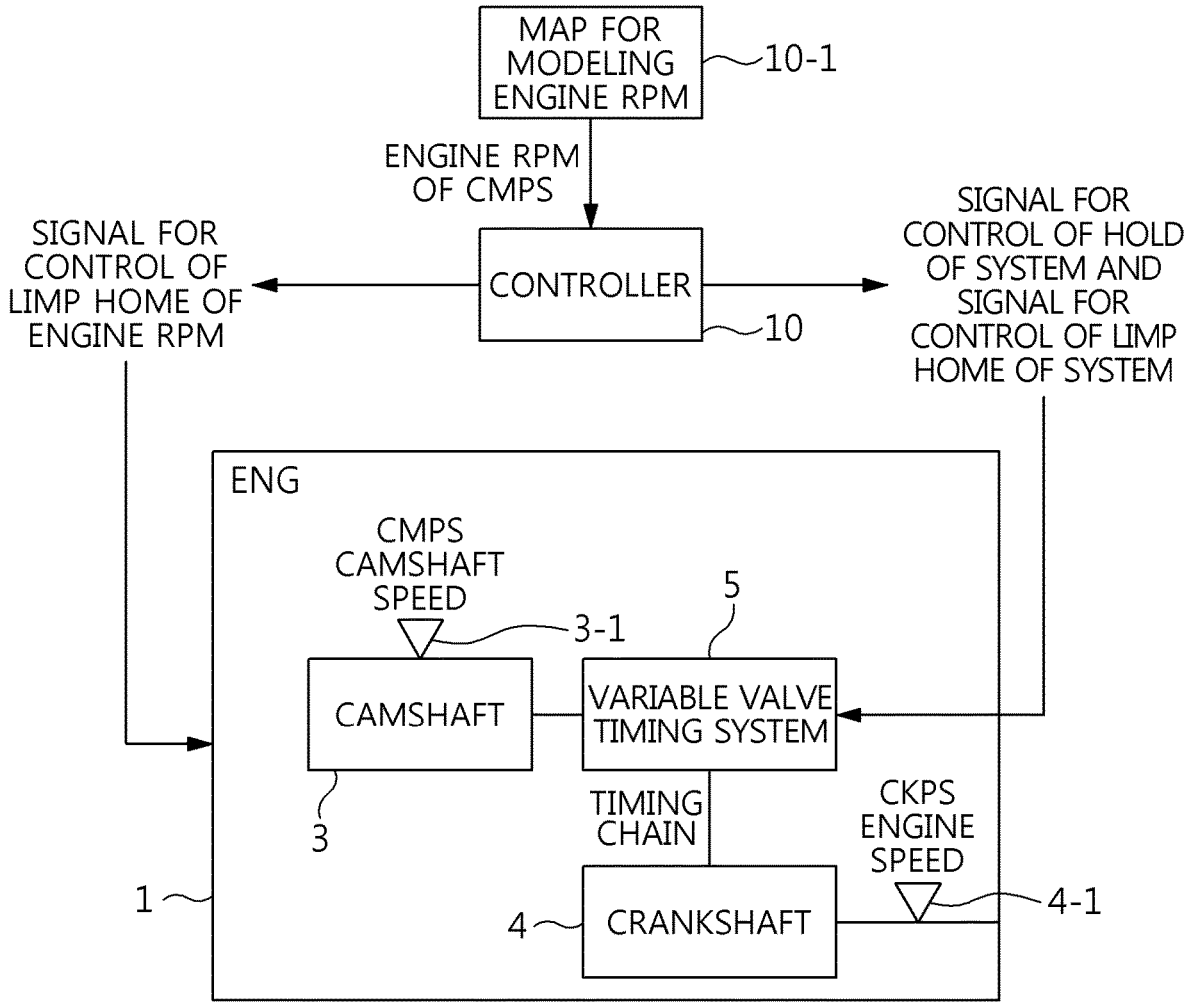
FIG. 4 is a block diagram showing a state of performing control before confirmation of abnormality of a CKPS of a vehicle for reinforcing anti-engine stall according to an exemplary embodiment of the present invention.

Referring to FIG. 4, the controller 10 performs step S60 by determining engine RPM modeling values of the engine RPM modeling. To this end, the controller 10 identifies the engine RPM modeling in the engine speed modeling map 10-1, and estimates (or determines) engine RPM modeling values from the plot diagram showing relationship between detection values of the CMPS and an engine RPM in the engine RPM modeling confirmed.

Afterwards, the controller 10 performs step S70 in which the current position of the variable valve timing system 5 is maintained and then performs step S80 in which limp home of the engine RPM is controlled. Maintaining the current position of the variable valve timing system 5 is directed to allow the controller 10 to output a hold signal to the variable valve timing system 5 such that operation of the variable valve timing system 5 under the condition that abnormality of the CKPS 4-1 is detected is maintained in the position at the time when abnormality of the CKPS occurs, preventing deterioration of accuracy of the engine RPM modeling using detection values of the CMPS.

The reason for this is that as the crankshaft 4 and the camshaft 3 are connected to each other by a timing chain, any difference in speed between the camshaft 3 and the module of the variable valve timing system 5 may occur at the time of advance/retard of the cam. When controlling limp home of the engine RPM, the controller 10 controls the number of rotations (RPM) of the engine 1 to be higher than the number of rotations (RPM) at the time when abnormality of the CKPS occurs so that output of the engine 1 is maintained at a constant torque. As a result, the engine 1 can secure stability of engine RPM, by which engine stall is not easily caused even when the step of controlling abnormality of the CKPS in S50-1 is not performed at the time of occurrence of abnormality of the CKPS.

Afterwards, the controller 10 performs step S90 in which system limp home of the variable valve timing system 5 is controlled. In the system limp home control, the controller 10 outputs a default signal to the variable valve timing system 5 whereby the variable valve timing system 5 is returned to the initial state by the default position. As a result, the variable valve timing system 5 is switched from the default position to the state of maintaining the control state in accordance with the hardware design condition in the state that stability of the engine RPM is secured.

Finally, the controller 10 performs step S100 of confirming display of the diagnostic trouble code (completion of error diagnosis of the CKPS), and continues to perform the present step until the diagnostic trouble code is displayed. As a result, since displaying the diagnostic trouble code means that the step of performing control before confirmation of abnormality of the CKPS is stopped, the controller 10 returns to the step S50 of confirming error diagnosis of the CKPS.

On the other hand, if the CKPS is in the normal state without abnormality in detection values of the CKPS in step S40, the controller 10 proceeds to step S40-1 of performing cam timing control of synchronization of the cam and therefore controls operation of the variable timing system 5. Furthermore, the controller identifies generation of the diagnostic trouble code in step S50 of confirming error diagnosis of the CKPS and then proceeds to step S50-1 of controlling abnormality of the CKPS, with the result that operation of the variable timing system 5 is controlled to be maintained in the position at the time of generation of the diagnostic trouble code.

Figure 5:
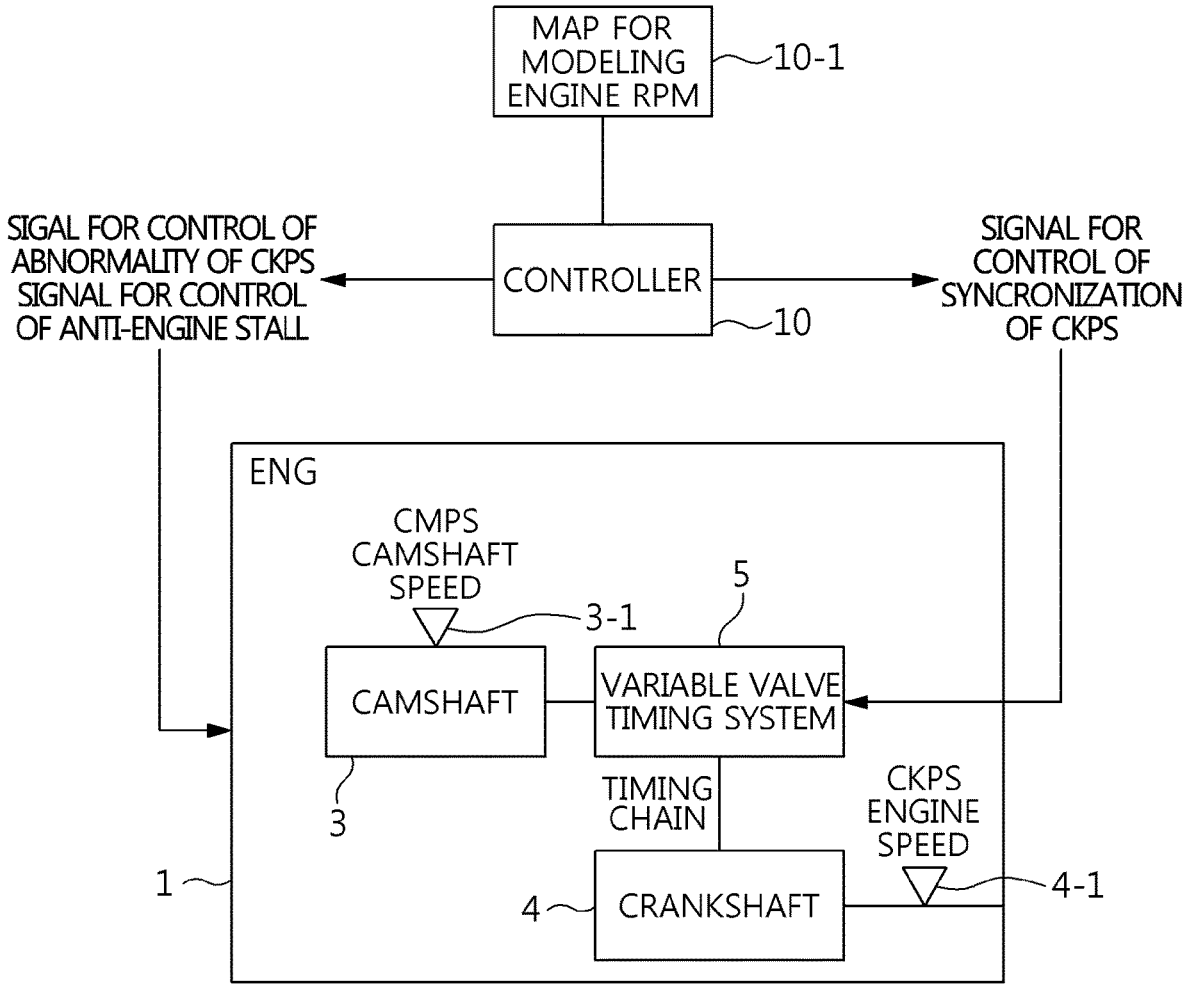
FIG. 5 is a block diagram showing a state of performing control of synchronization and control of abnormality of a CKPS of a vehicle for reinforcing anti-engine stall according to an exemplary embodiment of the present invention.

Referring to FIG. 5, in the cam timing control of the CKPS, the controller 10 outputs system control signal to the variable valve timing system 5 and applies count of a predetermined angle device and a timer to the CKPS 4-1, and performs engine control in which cam timing of the engine is synchronized with operation of the CKPS on the basis of top dead center of a piston stroke. Therefore, in the cam timing control of the CKPS, cam timing control of ignition timing of the engine 1 is performed based on detection values of the CKPS 4-1. On the other hand, when controlling abnormality of the CKPS, the controller 10 outputs control signal of engine RPM detected by the CMPS to the engine 1 whereby engine control is performed in a manner of controlling ignition timing of the engine based on estimation values of engine RPM, which are estimated based on detection values of the CMPS. Therefore, in the cam timing control of abnormality of the CKPS, after abnormality of the CKPS is detected and then a diagnostic trouble code is displayed, the number of rotations of the engine 1 is controlled to be equal that at the time of occurrence of abnormality of the CKPS whereby engine stall of the engine 1 is prevented.

Referring to FIG. 1 again, the controller 10 continues to the cam timing control in association with occurrence of abnormality of the CKPS until the engine is stopped as in step S200.

As described above, the method for reinforcing anti-engine stall according to an exemplary embodiment of the present invention, which is applied to a vehicle, has advantageous effects in that when abnormality of the CKPS for measuring speed of an engine is detected by a controller 10, the number of rotations of the engine 1 is controlled to be higher according to values of modeling engine RPM, which are estimated based on detection values of the CMPS 3-1, until a failure diagnosis code (e.g., diagnostic trouble code (DTC)) is displayed so that engine stall is prevented and at the same time the variable timing system 5 is maintained in the state at the time of detecting abnormality of the CKPS and then switched to a default state so that it is possible to prevent engine stall that can be caused by applying inaccurate engine RPM estimation values which are brought by variation of gear ratios of the crankshaft and the camshaft due to advance/retard movement of the cam when abnormality of the CKPS is detected.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method for reinforcing anti-engine stall, the method comprising:

performing a cam timing control for enhancing modeling an engine speed of an engine by a camshaft position sensor (CMPS) wherein, when abnormality of a crank position detector is detected by a controller, the engine speed of the engine is controlled to be higher than an engine speed at a time when the abnormality of the crank position detector occurs while maintaining position for cam phase control operation of a variable timing system.

2. The method according to claim 1, wherein modeling of revolutions per minute (RPM) of the engine is applied to the engine control, wherein the modeling is calculated by the camshaft position sensor (CMPS).

3. The method according to claim 2, wherein the engine RPM modeling is continuously performed with activation of the engine.

4. The method according to claim 1, wherein the maintaining of the position of the variable timing system includes maintaining a state at a time when the abnormality of the crank position detector is detected and switching the state to a default state after a limp home to secure stability of engine RPM.

5. The method according to claim 1, wherein a diagnostic trouble code is applied to the cam timing control until the diagnostic trouble code is displayed.

6. The method according to claim 1, wherein the cam timing control includes:

detecting the abnormality of the crank position detector with respect to a crankshaft after the engine is activated and controlled;

determining values of engine control to engine RPM modeling values in an engine RPM modeling generated by detection values of a camshaft position detector with respect to a camshaft when the abnormality of the crank position detector is detected;

after the engine RPM values for engine control is changed to the engine RPM modeling values calculated continuously, maintaining a current position of the variable valve timing system at a time of occurrence of the abnormality of the crank position detector such that the position for the cam phase control operation of the variable valve timing system is maintained;

controlling a number of rotations of the engine to be higher based on the engine RPM modeling values after the engine RPM modeling values are estimated so that engine stall of the engine is prevented;

returning the variable valve timing system back to a default position, and confirming error diagnosis of the crank position detector.

7. The method according to claim 6, wherein the engine RPM modeling values are estimated when display of the diagnostic trouble code is identified according to detection of the abnormality of the crank position detector at a time of detecting the abnormality of the crank position detector but subsequently the diagnostic trouble code is not displayed and wherein the confirming of the error diagnosis of the crank position detector is performed by identifying display of the diagnostic trouble code.

8. The method according to claim 7, wherein the display of the diagnostic trouble code is performed as the abnormality of the crank position detector is maintained for a predetermined time period from a time point when the abnormality of the crank position detector is detected.

9. The method according to claim 6, wherein the position for the cam phase control operation of the variable valve timing system is maintained after the error diagnosis of the crank position detector is detected.

10. The method according to claim 6, wherein the detecting of whether the crank position detector is abnormal is performed as identifying the abnormality of the crank position detector and wherein the identifying of the abnormality of the crank position detector includes:

performing activation and control of the engine, synchronizing the camshaft and the crankshaft along with identifying the default position of the variable timing system, generating detection values of the camshaft position detector with respect to the camshaft and establishing values of engine control to the engine RPM modeling values based on these detection values, and generating detection values of the crank position detector with respect to the crankshaft and identifying occurrence of the abnormality of the crank position detector based on these detection values.

11. The method according to claim 10, wherein the engine RPM modeling is continuously performed during generation of the detection values of the camshaft position detector.

12. The method according to claim 6, wherein, when the abnormality of the crank position detector is not detected, switching to a step where performing a cam timing control is conducted, in which ignition timing of the engine is controlled along with controlling the cam phase control operation of the variable timing system.

13. The method according to claim 6, wherein after the error diagnosis of the crank position detector is confirmed, switching to a step wherein performing a control of the abnormality of the crank position detector is conducted and wherein the performing of the control of the abnormality of the crank position detector controls the number of rotations of the engine based on the detection values of the camshaft position detector so that the engine stall is prevented.

14. The method according to claim 11, wherein the performing of the cam timing control is conducted based on the detection values of the crank position detector.

15. The method according to claim 14, wherein the control of the number of rotations of the engine is performed based on engine RPM estimation values resulting from the detection values of the camshaft position detector.

16. A vehicle comprising:

a camshaft position detector for detecting a rotation speed of a camshaft;

an engine including a crank position detector for detecting a rotation speed of a crankshaft for transmitting a rotational force to the camshaft;

a variable valve timing system coupled to the camshaft to control an cam timing of the engine and a control phase of a cam; and a controller configured for controlling the engine and the variable valve timing system respectively when inaccurate estimation values of RPM is derived by engine RPM modeling values, wherein the controller includes a map for modeling revolutions per minute (RPM) of the engine, by which an engine RPM modeling is performed based on detection values of the camshaft position detector, wherein the engine RPM modeling estimates the engine RPM modeling values from a time when abnormality of the crank position detector occurs until a time when a diagnostic trouble code is displayed and the engine RPM modeling values are applied in controlling a number of rotations of the engine to prevent engine stall of the engine, and wherein the number of rotations of the engine is configured to be controlled to be higher than a number of rotations at a time when the abnormality of the crank position detector occurs.

17. The vehicle according to claim 16, wherein upon applying the engine RPM modeling values, maintaining a state of the variable valve timing system when the abnormality of the crank position detector is detected.

18. The vehicle according to claim 16, wherein error diagnosis of the crank position detector is completed after the diagnostic trouble code is displayed.

* * * * *